US007600302B2

(12) United States Patent
Dillner

(10) Patent No.: US 7,600,302 B2
(45) Date of Patent: Oct. 13, 2009

(54) SAFETY BUCKLE FOR CHILD SEAT AND THE LIKE

(76) Inventor: James Michael Dillner, 26 Circleview Dr., Leola, PA (US) 17540

( * ) Notice: Subject to any disclaimer, the term of this patent is extended or adjusted under 35 U.S.C. 154(b) by 436 days.

(21) Appl. No.: 11/487,791

(22) Filed: Jul. 17, 2006

(65) Prior Publication Data

US 2008/0010790 A1 Jan. 17, 2008

(51) Int. Cl.
*A44B 11/25* (2006.01)
*A44B 11/26* (2006.01)

(52) U.S. Cl. ..... 24/615; 24/614; 24/625

(58) Field of Classification Search ..... 24/579.11, 24/614, 615, 616, 625, 662
See application file for complete search history.

(56) References Cited

U.S. PATENT DOCUMENTS

| | | | | |
|---|---|---|---|---|
| 4,540,218 | A | 9/1985 | Thomas | |
| 4,617,705 | A | 10/1986 | Anthony et al. | |
| 4,688,337 | A | 8/1987 | Dillner et al. | |
| 4,692,970 | A | 9/1987 | Anthony et al. | |
| 4,712,280 | A | 12/1987 | Fildan | |
| 5,023,981 | A | 6/1991 | Anthony et al. | |
| 5,038,446 | A | 8/1991 | Anthony et al. | |
| 5,086,548 | A | 2/1992 | Tanaka et al. | |
| 5,142,748 | A | 9/1992 | Anthony et al. | |
| 5,182,837 | A | 2/1993 | Anthony et al. | |
| 5,220,713 | A | 6/1993 | Lane, Jr. et al. | |
| 5,274,890 | A | 1/1994 | Shimizu et al. | |
| 5,279,505 | A | 1/1994 | Goudreau et al. | |
| 5,283,933 | A | 2/1994 | Wiseman et al. | |
| 5,406,681 | A | 4/1995 | Olson | |
| 5,438,737 | A | 8/1995 | Anscher et al. | |
| 5,507,076 | A | 4/1996 | Anscher | |
| 5,542,161 | A * | 8/1996 | Anscher | 24/614 |
| 5,546,642 | A | 8/1996 | Anscher | |
| 5,590,444 | A | 1/1997 | Krauss | |
| 5,604,964 | A | 2/1997 | Aoshima | |
| 5,659,931 | A | 8/1997 | Anscher | |
| 5,813,097 | A | 9/1998 | Woellert et al. | |
| D402,589 | S | 12/1998 | Lundstedt | |
| 5,996,192 | A | 12/1999 | Haines et al. | |
| 6,000,109 | A | 12/1999 | Anscher | |
| 6,061,883 | A * | 5/2000 | Uehara | 24/625 |
| 6,311,374 | B1 | 11/2001 | Anscher | |
| 6,393,677 | B1 | 5/2002 | Anscher | |
| 6,408,494 | B1 | 6/2002 | Anscher | |
| 6,446,314 | B1 | 9/2002 | Anscher | |
| 6,543,101 | B2 | 4/2003 | Sack et al. | |
| 6,796,007 | B1 * | 9/2004 | Anscher | 24/625 |
| 6,931,695 | B2 * | 8/2005 | Anscher | 24/614 |
| 7,464,447 | B2 * | 12/2008 | Khalifa et al. | 24/615 |

* cited by examiner

*Primary Examiner*—Robert J Sandy
*Assistant Examiner*—Ruth C Rodriguez

(57) ABSTRACT

A buckle for use with infant seats and the like having a release button slideably mounted within a hollow buckle housing for simultaneously releasing a pair of male buckle members latched in the housing. A bottom bar is slideably mounted into the housing and provided with locking hooks received within openings provided in the housing for permanently locking the bottom bar to the housing. The bottom bar and male projection members are provided with openings for webbing belts. The housing has integral guide ribs for guiding the male members and bottom bar when inserted into the housing to ensure proper insertion and alignment in the housing. All of the members of the buckle assembly are preferably molded of a suitable plastic material.

6 Claims, 9 Drawing Sheets

SAFETY BUCKLE FOR CHILD SEAT AND THE LIKE

FIELD OF INVENTION

The present invention relates to child seats and the like and more particularly to a rugged, substantially child proof safe buckle.

BACKGROUND

Child seats such as seats employed in cars and airplanes, as well as other forms of transportation, carriages, strollers and swing seats, to name just a few. It is necessary to provide a buckle which is child-safe, easy to use and child proof and having a design which provides a high level of rugged and continuous service.

SUMMARY

The present invention is characterized by comprising a buckle assembly having a main body to which a pair of male members are releasably connected. Each male member has a positioning projection with slot for receiving a guide rib provided in the main body of the buckle as well as a flexible locking projection provided with a hook which is releasably locked within the body of the buckle. A spring-loaded buckle button is normally biased in a first direction away from the male buckle members to enable the male buckle members to be retained in the locked position. The buckle button, when moved in a second direction against the biasing force of the integral spring member, is provided with a pair of cam surfaces which slideably engage cam-follower surfaces on the hook projection of the male hook member to urge them away from cooperating locking members provided in the hollow buckle body.

A substantially U-shaped bottom bar is provided with a pair of integral arms each having a hook with protrudes though an associated opening in the buckle body to retain the buckle bottom locked in the buckle body.

The individual components are rugged and capable of providing a long, useful operating life while at the same time being capable of being inexpensively molded. All of the components are preferably formed of a suitable plastic or reinforced plastic material, further reducing manufacturing costs while providing a rugged, child-proof design. The buckle bottom bar and the male hook members are provided with elongated openings for receiving a webbing belt. In cases where a wide crotch strap is employed for use of the buckle in strollers or the like, the wide strap may be wrapped about the yoke portion of the bottom buckle bar.

The buckle is easy to use by adults and yet child-proof, thereby providing a safe and rugged buckle assembly adaptable for use in a wide variety of child and infant seats and other like devices.

BRIEF DESCRIPTION OF THE DRAWING(S)

The present invention will be understood from a consideration of the detailed description and drawings, wherein like elements are designated by like numerals and, wherein.

DETAILED DESCRIPTION OF THE PREFERRED EMBODIMENT(S)

Figure 1:
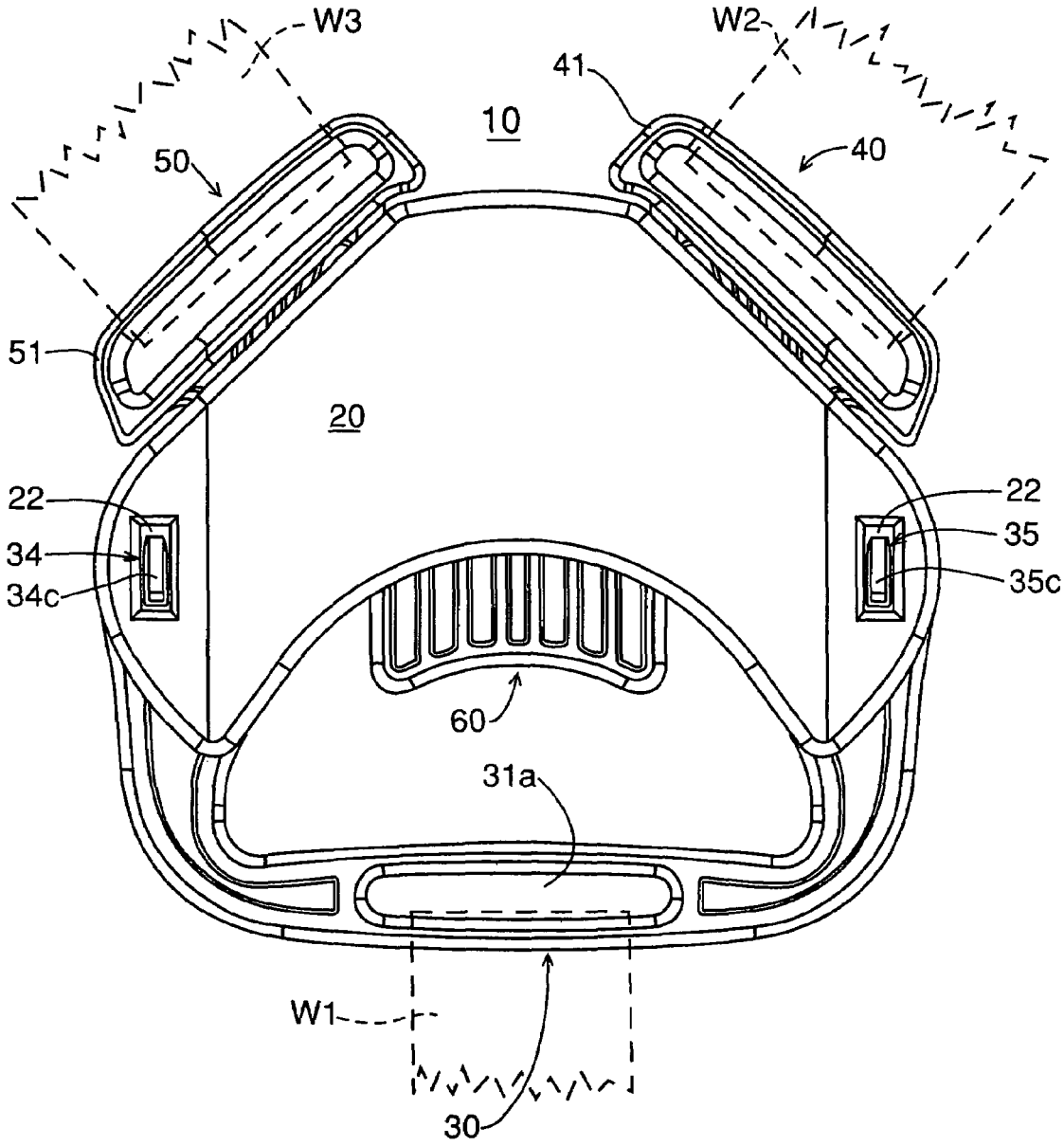
FIG. 1 is a plan view showing a fully assembled belt buckle embodying the principles of the present invention.

Making reference to FIGS. 1 to 3A, there is shown therein a buckle assembly 10 comprised of a main buckle body 20, a bottom buckle bar 30, a pair of male buckle members 40 and 50 and a button assembly 60. The bar 30 receives a webbing belt W1 which is positioned in the crotch areas of an infant/child and the members 40, 50 receive webbing belts W2, W3 that extend over the shoulders of the infant/child.

The bottom buckle bar 30 is a substantially U-shaped member having a yoke portion 31 with a elongated opening 31*a* for receiving a belt webbing W1, shown in dotted fashion. A pair of arms 32 and 33 integral with yoke portion 31 both extend in the same direction at opposite ends of the yoke portion and are provided with end projections 32*a*, 33*a* each having an integral hook-shaped projections 34, 35 so that their lower ends 34*b*, 35*b* project further away from the arms 32 and 33, thereby providing sloping surfaces 34*c*, 35*c*.

The arms 32 and 33 are slideably inserted into the bottom end of hollow buckle body 20, which is provided with pairs of integral guides 21 which align and guide the hooks, such as hook 34, into the interior of buckle housing 20. Buckle housing 20 is further provided with rectangular-shaped openings 22 each conforming in shape to and receiving one of the locking projections 34, 35. Making reference to FIG. 1, it can be seen that locking projections 34 and 35 are fully seated within each of the openings 22 when properly and fully inserted into housing 20. The sloping surfaces 34*c*, 35*c* facilitate insertion of the bottom bar 30 into the buckle housing 20. It should be understood that the opposite surface of bottom bar 30 contains a second pair of locking projections substantially identical in design and function to the locking projections 34 and 35 shown, for example, in FIGS. 1 and 2B, and that these locking projections are guided by similar guide ribs in buckle housing 20 and are likewise provided with sloping surfaces for insertion into their associated rectangular-shaped openings such as the openings 22 shown in FIGS. 1 and 2B.

Each arm 32, 33 of bottom bar 30 is provided with a shoulder 32*b*, 33*b* which rests against a cooperating surface of wall portions 23*c*, 23*c* which form part of a substantially S-shaped wall comprised of wall portions 23*a*, 23*b*, 23*c*, 23*d* and 23*e*, when the bottom bar 30 is properly seated within buckle housing 20. The bottom bar 30, once inserted into the buckle housing 20 is designed so as to be permanently retained within the buckle housing. Providing the buckle housing and bottom bar as two separate components significantly simplifies production costs by enabling the buckle housing and bottom bar to be separately molded or otherwise produced.

Figure 2:
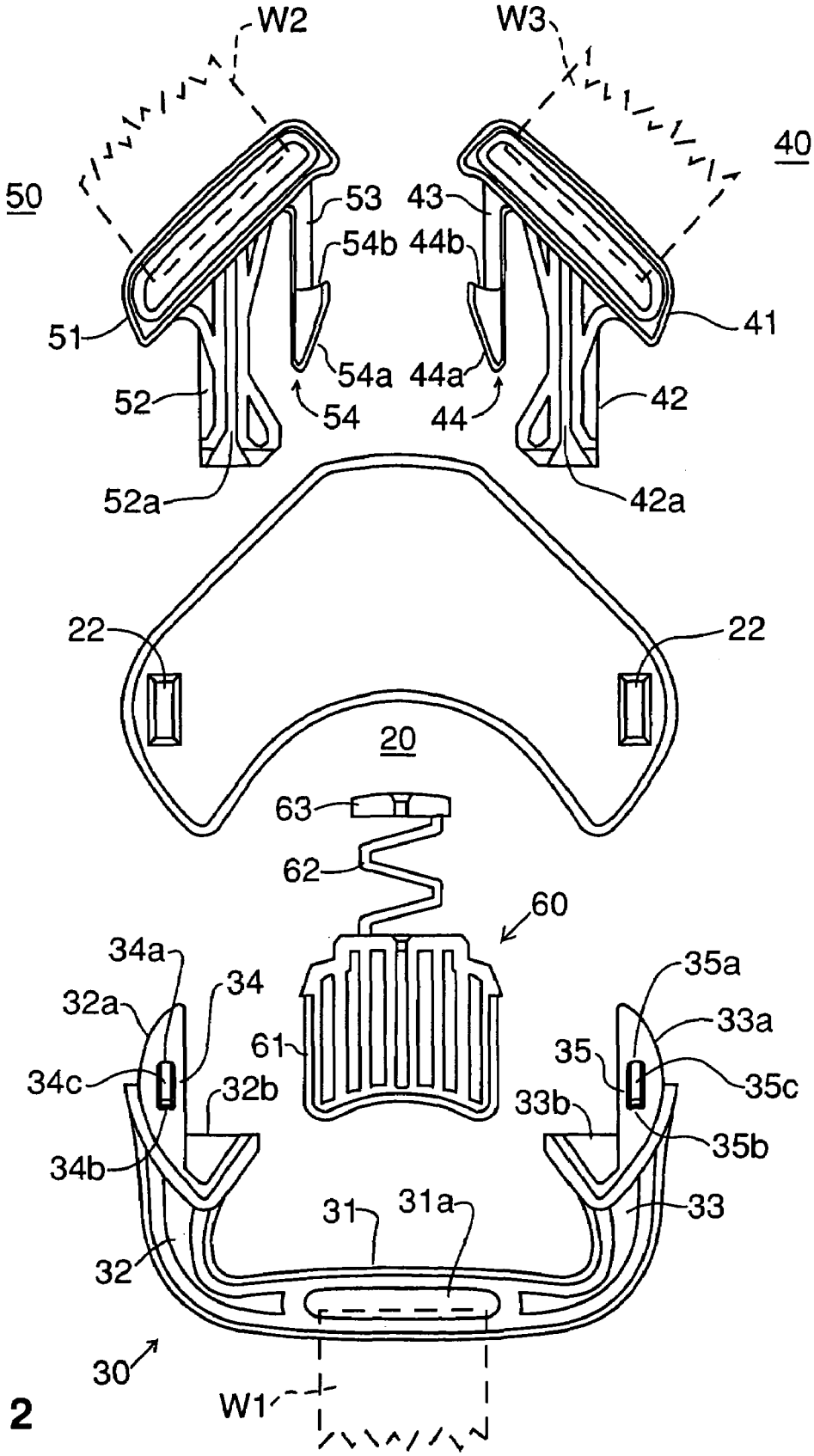
FIG. 2 shows an exploded view of the belt buckle of FIG. 1.
Figure 2A:
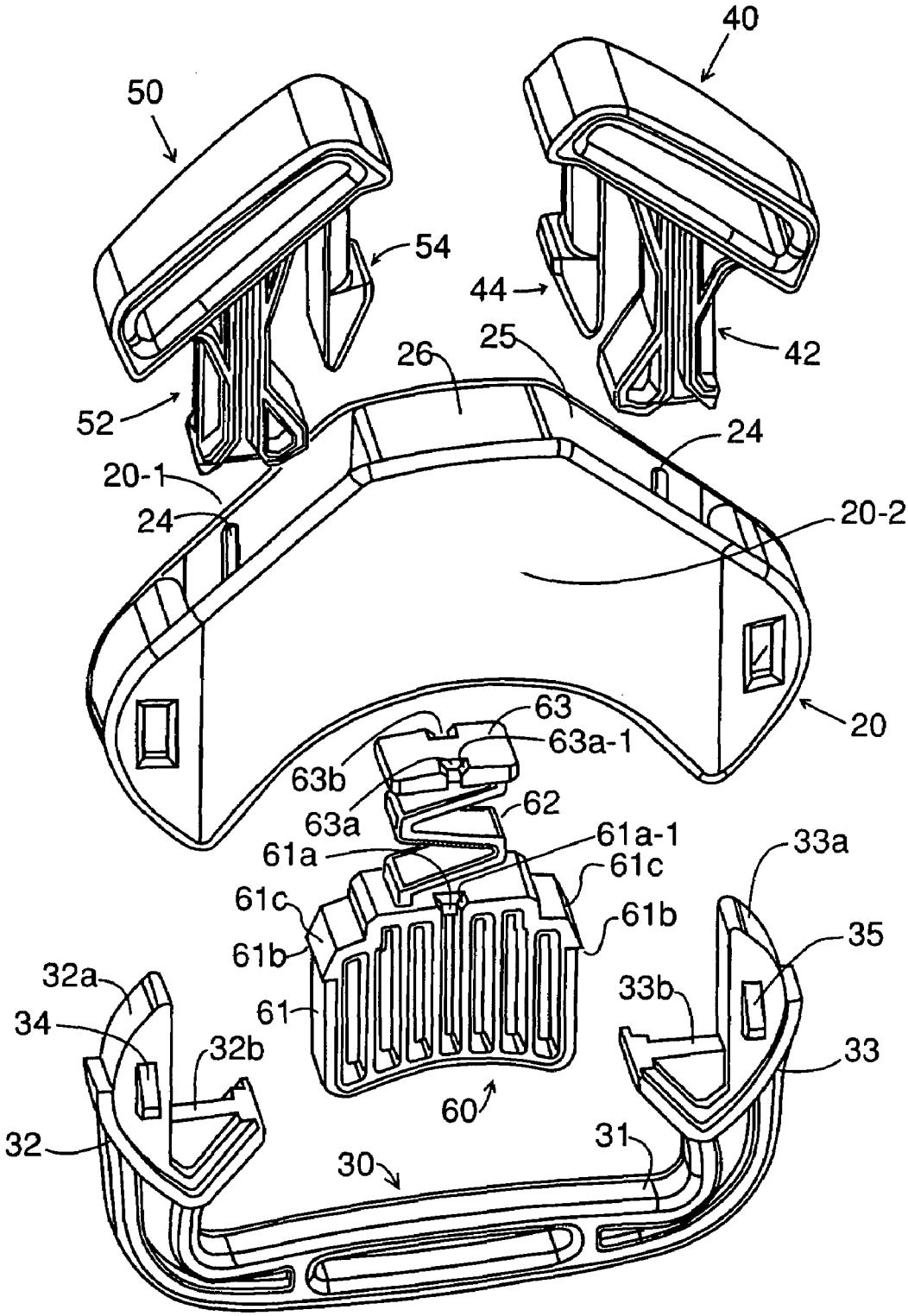
FIGS. 2A and 2B are exploded perspective views of the belt buckle of FIG. 1 respectively looking substantially down toward the top and substantially up toward the bottom of the buckle assembly.
Figure 3A:
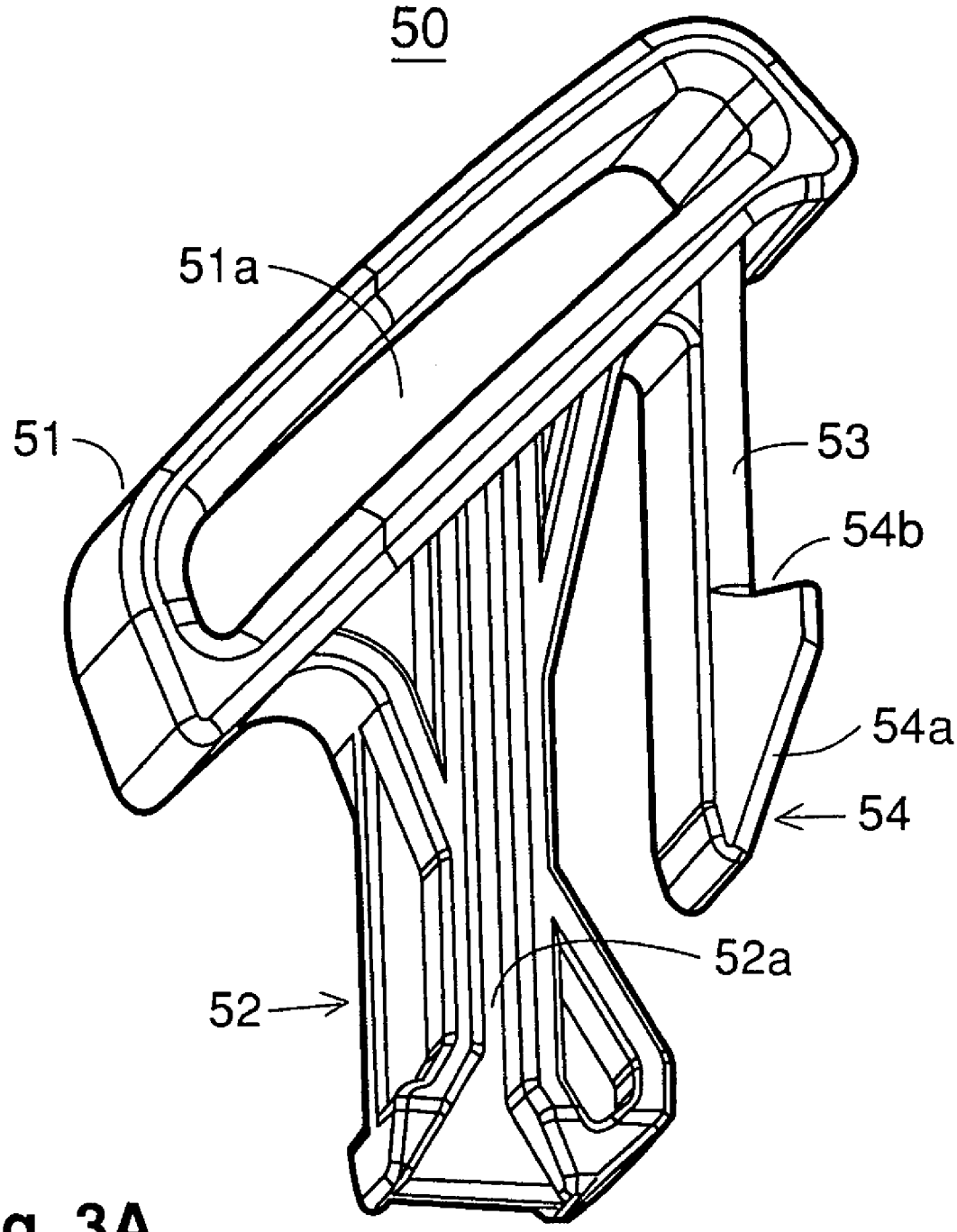
FIGS. 3A and 3B are perspective views of one of the male buckle members respectively looking substantially toward the left and right hand sides thereof.
Figure 3B:
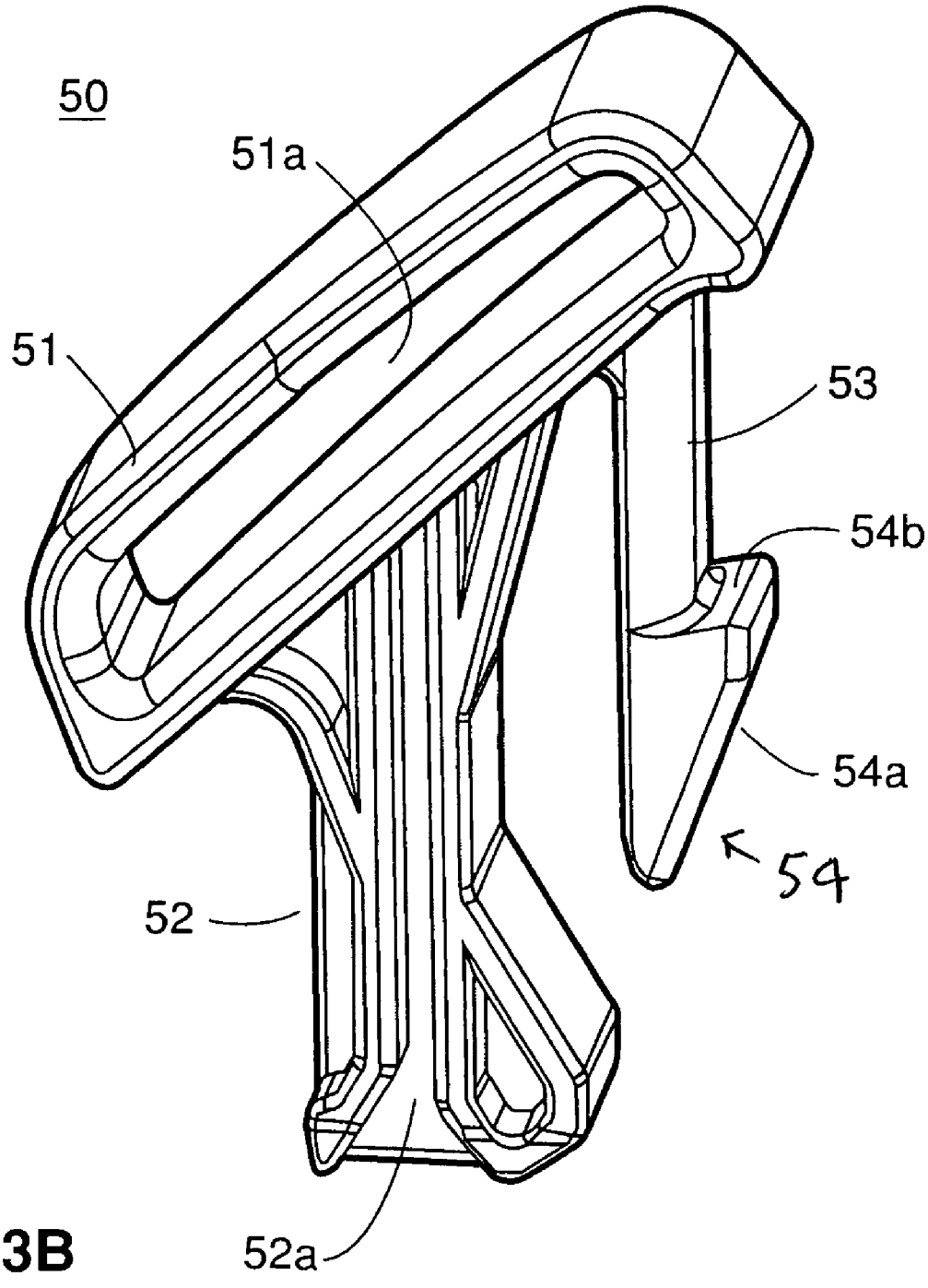
Figure 4A:
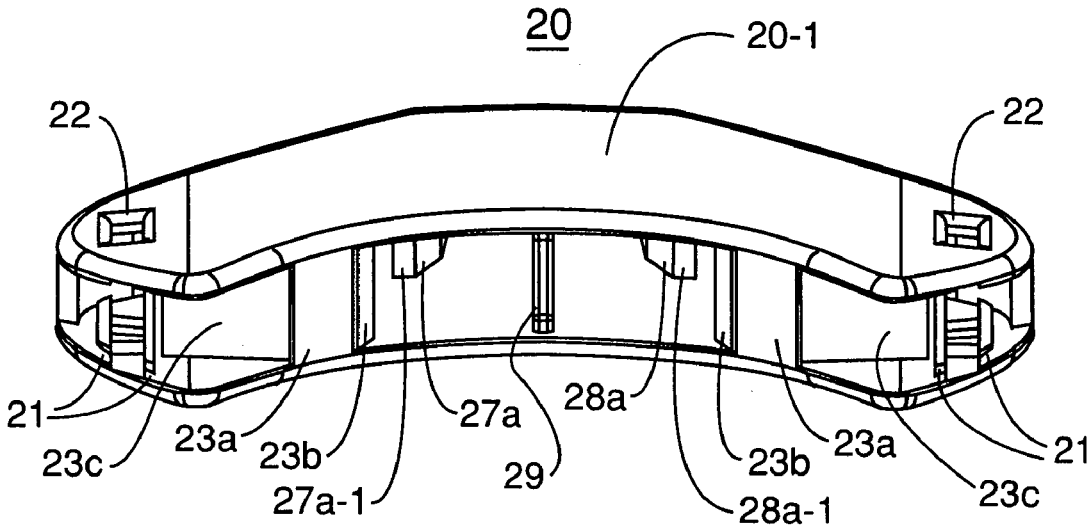
FIGS. 4A and 4B are perspective views of the buckle body respectively looking in the direction of the bottom and top ends thereof.
Figure 4B:
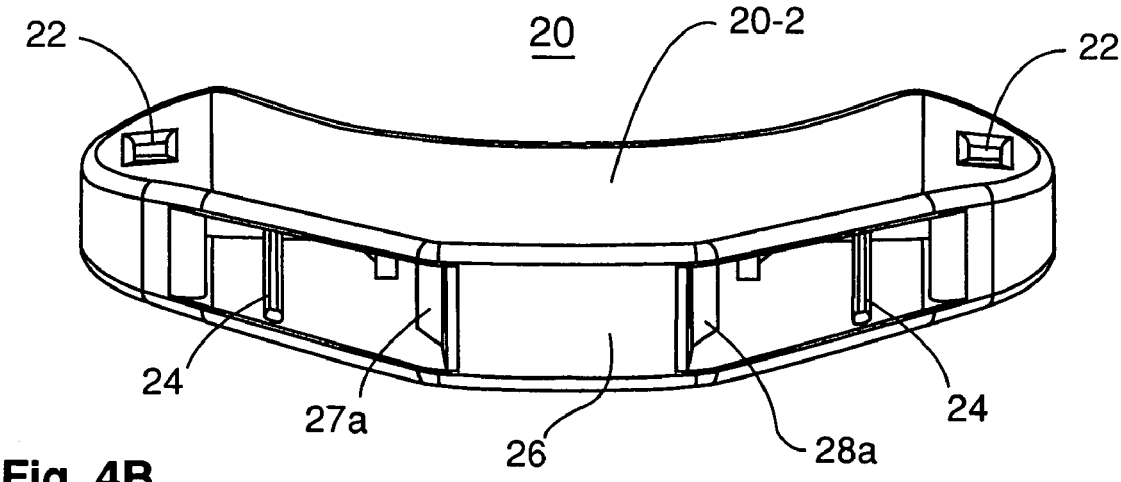

The male buckle members 40 and 50 are substantially identical in both design and function and only one is shown in detail in FIGS. 3A and 3B for purposes of simplicity. FIGS. 1, 3A and 3B, for example, show male buckle members 40, 50 as comprised of a main body portion 41, 51 having a elongated opening 41*a*, 51*a* for receiving a webbing strap. Extending downwardly from male buckle members 40, 50 is an integral positioning projection 42, 52, having an elongated slot 42*a*, 52*a*. Although not shown for purposes of simplicity, it should understood that a similar elongated slot is provided along the opposite surface of projections 42, 52. Opposite interior surfaces of buckle housing 20 are provided with elongated ribs which slidingly engage an associated one of the elongated slots, such as slots 42*a*, 52*a*, on opposite sides of positioning projection 52, for example. FIG. 2A shows two of the guide ribs 24 which are integrally joined to interior surface 25. The opposite interior surface likewise has a pair of similar guide ribs, not shown for purposes of simplicity.

Male buckle members 40, 50 are further provided with an intergral locking projection 43, 53 extending downwardly from body portion 41, 51 and having a hook-shaped end 44, 54 comprised of a sloping surface 44*a*, 54*a* and a hook-shaped portion 44*b*, 54*b*.

Figure 6:
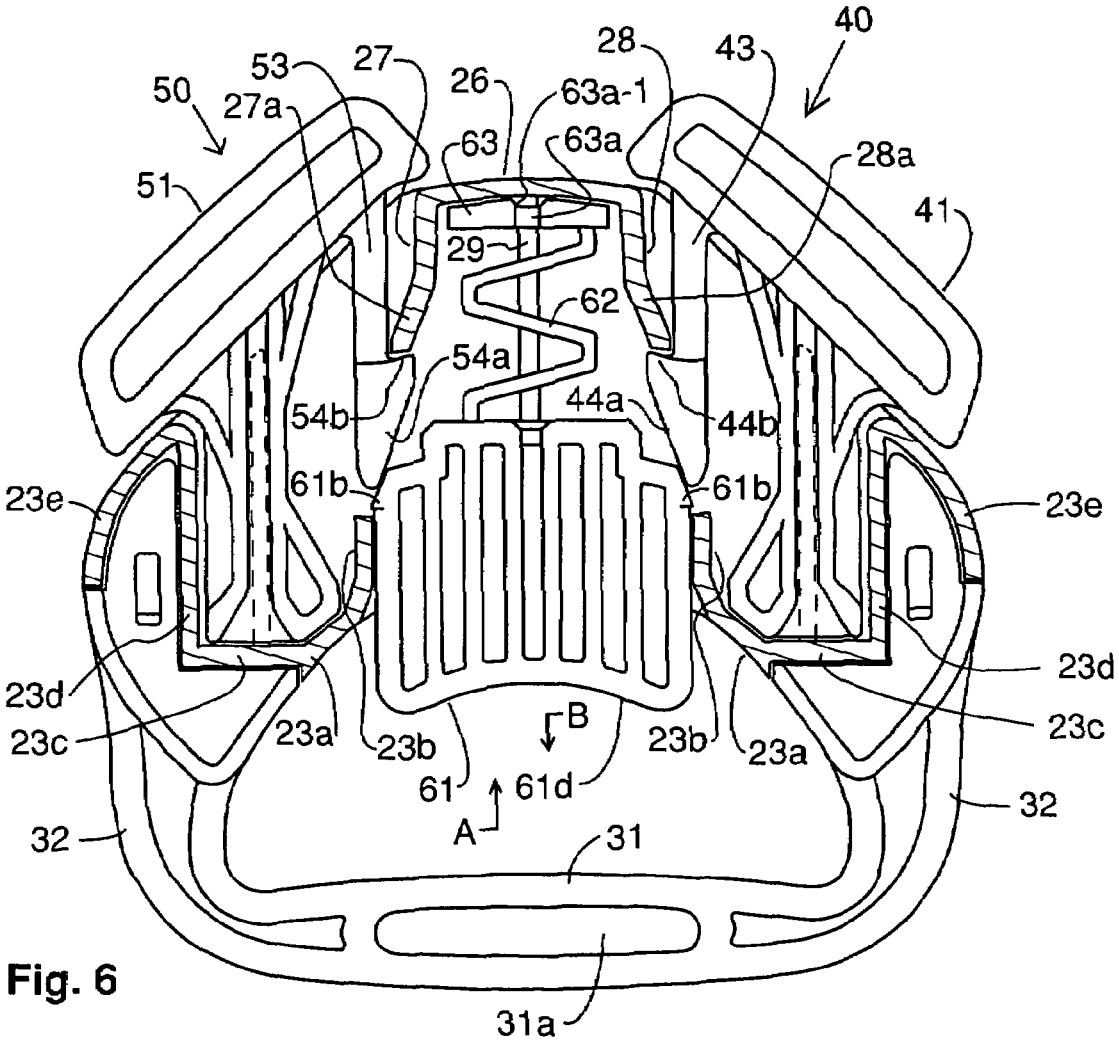
FIG. 6 shows a sectional view of the fully assembled buckle showing all of the components in greater detail.

The upper end of buckle housing 20, as show in FIGS. 2*a* and 6, has a centrally located wall 26 spanning between and integral with the two opposite side surfaces 27 and 28 and extending downwardly and inwardly into the hollow interior of buckle housing 20, each being tapered outwardly and away from one another at their lower ends, to define a latching end 27*a*, 28*a*, each adapted to engage a surface 44*b*, 54*b* of associated male hooks, 44*b*, 54*b* shown, for example, in FIG. 6.

Figure 5:
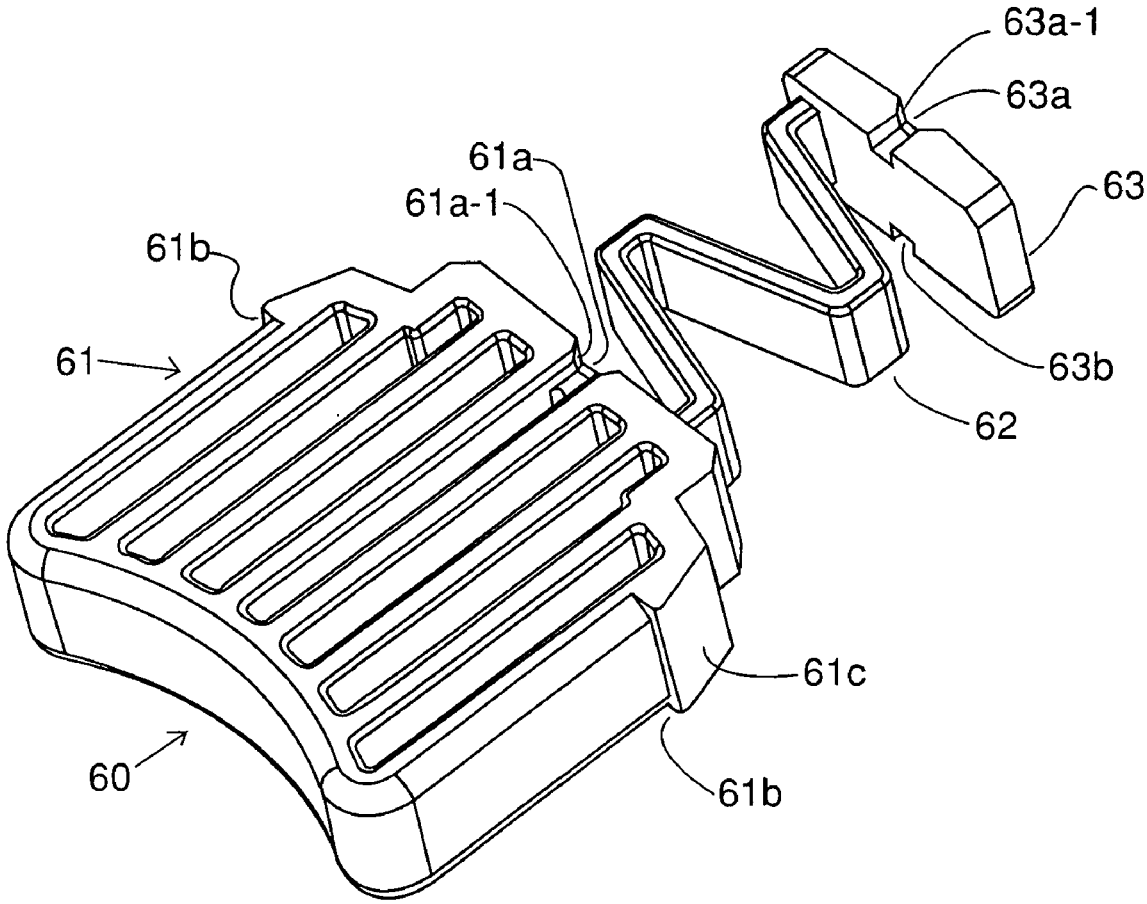
FIG. 5 is a perspective detailed view of the buckle button.

The buckle release button 60, shown in detail in FIG. 5, comprises a main body portion 61 and a plastic biasing spring portion 62 integrally joined at one end to button 61 and terminating at the opposite end in end portion 63 and having an undulating, sawtooth configuration.

Figure 2B:
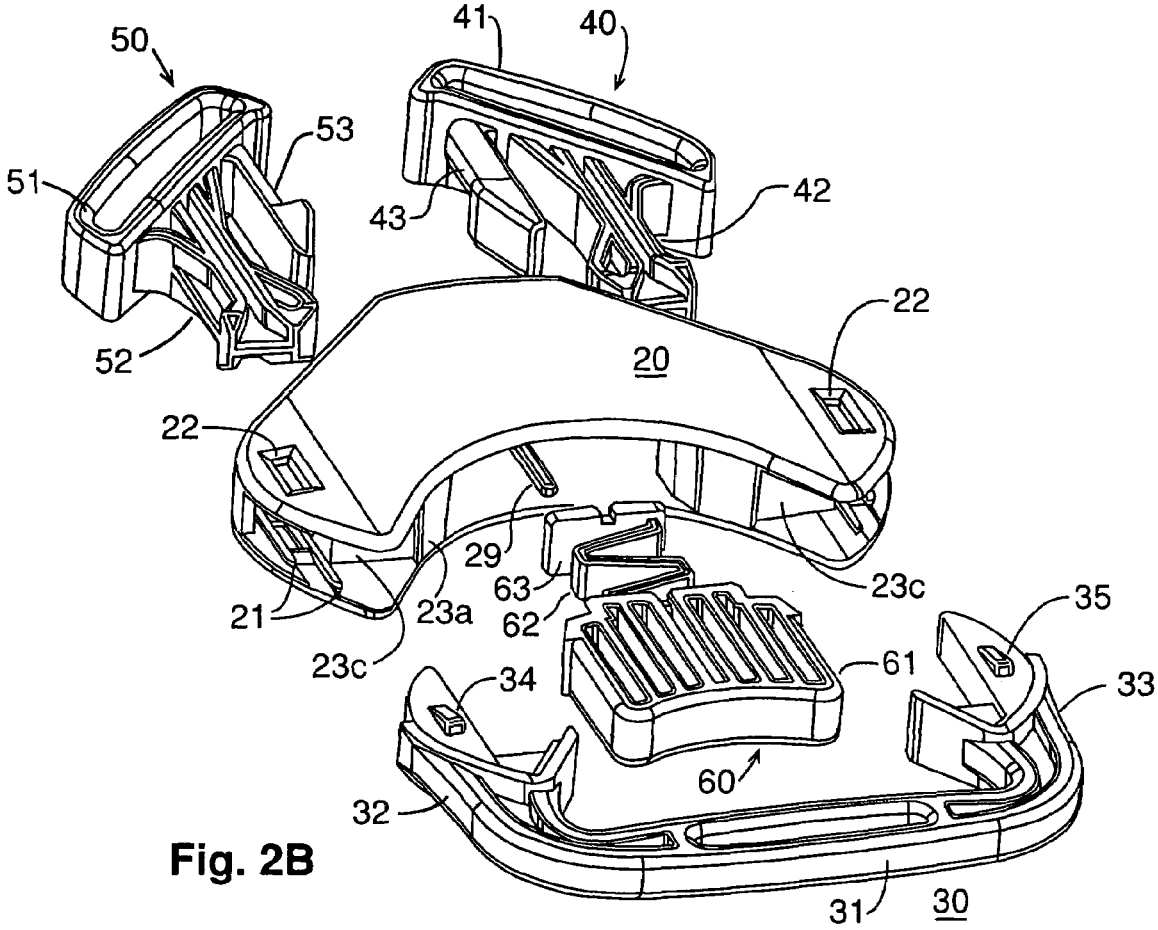

Opposite side surfaces of body 61 are each provided with an elongated slot 61*a*, 61*a* and opposite side surfaces of end portion 63 are each provided with a slot 63*a*, 63*b*, which slots receive cooperating guide ribs arranged along opposite interior surfaces of the buckle body 20. The slots 61*a* and 63*a* taper outwardly at 61*a*-1 and 63*a*-1 to facilitate insertion of the button assembly into buckle body 20. FIG. 2B shows one of these integral guide ribs 29, a similar guide rib being provided along the opposite interior surface 20-1.

The bottom end of buckle housing 20 is further provided with flexible wall portions 23*b* each being joined to adjacent wall portions 23*a*, as shown in FIGS. 2B and 6, which wall portions are positioned between and spaced from the interior surfaces of side walls 20-1 and 20-2 of housing 20, and have upwardly extending end portions 23*b* which serve as hooks for locking against cooperating hooks 61*b* on the main body 61 of button 60, as shown in FIGS. 2A, 5 and 6.

Button assembly 60 is assembled to button body 20 by insertion through the bottom end of the buckle body and is pushed into buckle body, moving in the direction of arrow A shown in FIG. 6. The guide ribs, such as guide rib 29, guide the button assembly and properly position the button assembly within the button housing 20. The button assembly 60 is pushed into the housing 20 so that the terminal end 63 engages the interior surface of wall 26. Sloping surfaces 61*c*, on opposite sides of button 61, each engage one of the hook-shaped wall portions 23*b* causing them to flex and separate slightly, and when latching ends 61*b*, 61*b* move past the free ends of flexible hook-shaped members 23*b*, hook shape members 23*b* snap into the position whereby their free ends each engage one of the hooks 61*b* on button 61 to retain the button assembly 60 locked into position in the button housing. Spring 62 normally urges button body, in the direction of arrow B to retain hooks 23*b* in engagement with cooperating hooks 61*b*.

As was mentioned above, each male buckle member 40, 50 is inserted into the buckle housing and guided by the ribs such as ribs 24 to be assured that they are properly positioned. The sloping surfaces 54*a*, 44*a* slide against the outer surfaces of downwardly extending wall portions 27*a*, 28*a* and are flexed away from one another until they clear the free ends 27*a*-1, 28*a*-1 of members 27*a*, 28*a* whereupon they snap into the locked positions shown in FIG. 6 where they are retained locked within the button housing 20.

To release the male buckle members 40 and 50, the button body 61 is moved upwardly in the direction shown by arrow A in FIG. 6, by pressing against the bottom surface 61*d* of the button main body 61. This movement presses the sloping surfaces 61*c* against cooperating sloping surfaces 54*a*, 44*a* causing the integral locking members 53, 43 to flex and move away from one another so as to separate their surfaces 54*b*, 44*b* from the engaging ends of walls 27*a*, 28*a*, enabling the male buckle members to be easily removed from the buckle housing.

The wall portions 23*c*, 23*d* and 23*e* of S-shaped walls 23 conform to the shape of portions 32*a*, 32*b* of bottom bar 30 and the wall portions 23*d*, 23*c* and 23*a* conform to the shape of the positioning arms 52, 42 of male buckle members 50, 40 whereby the walls 23 are common to member 50 and arm 32 and member 40 and arm 33, thereby providing a unique common wall for positioning and supporting two members on opposite sides thereof when inserted into the buckle body.

The symmetrical design of the buckle assembly of the present invention enables both male buckle members to be unlatched simultaneously using a single, common release button, in contrast to present day designs in which each of the shoulder straps require a separate latching mechanism and typically require that each latch be provided with not one but two flexible latching arms, each latch assembly requiring an opening operation independent of one another. In addition, as an important safely feature the design of the latching assembly of the present invention, the operating portion of the release button is removed from the flexible hook members of the male buckle members and the hook-shaped members concealed within the buckle housing to prevent the fingers of the person releasing the latched male projection members from having his (her) fingers pinched. In addition, the unique design permits all of the components to be produced in a simple molding operation. The biasing member 62 and flexing arms 43, 53 and 23*b*, 23*b* are respectively integral portions of the button, male buckle members and wall 23 while providing a design in which conventional fasteners are totally eliminated and the number of components are significantly reduced as compared with conventional designs.

The buckle assembly of the present invention has a design which facilitates molding of all of the components which are rugged and provide a long, useful operating life.

What is claimed is:

1. A buckle for a child seat, comprising:

a hollow housing having a pair of integral latching portions;

a pair of male buckle members each having a flexible hook arm configured to be latched in said housing by one of said latching portions;

a delatching button slidably mounted in said housing and having a pair of delatching portions slidably engaging an associated one of said hook arms; and said button releasing both of said hook arms from said latching portions when moved in a first direction; and a substantially U-shaped bottom buckle bar having a yoke portion and a pair of integral arms;

each arm having hooks on opposite sides thereof positioned for insertion into openings in said housing sidewalls for retaining said bottom buckle bar to said housing.

2. The buckle of claim 1, said bottom bar yoke portion having an elongated opening for receiving a webbing belt.

3. The buckle of claim 1, the arms of said bottom buckle bar each having a shoulder engaging an associated wall of said housing to limit insertion of said bottom buckle bar into said housing to a given depth.

4. The buckle of claim 1, said housing having guide projections along opposite interior surfaces of said housing for guiding and positioning said hooks on said bottom buckle bar when the bottom buckle bar is inserted into said housing.

5. The buckle of claim 1, said housing having a pair of positioning walls each having a substantially S-shaped configuration, each positioning wall conforming to one end of a positioning arm of one male member on one side thereof and conforming to an end of one arm of said bottom buckle bar on an opposite side of each positioning wall to properly position said male members and said bottom buckle bar in said housing.

6. The buckle of claim 5 wherein said positioning walls are integrally joined to opposing sidewalls of said buckle.

* * * * *